US007755564B2

(12) United States Patent
Gonzalez et al.

(10) Patent No.: US 7,755,564 B2
(45) Date of Patent: Jul. 13, 2010

(54) DEPLOYABLE PHASING SYSTEM FOR EMULATING REFLECTIVE SURFACES

(75) Inventors: Dino C. Gonzalez, Thousand Oaks, CA (US); Daniel G. Gonzalez, Topanga, CA (US); Leslie E. Oliver, Thousand Oaks, CA (US)

(73) Assignee: Communications & Power Industries, Inc., Palo Alto, CA (US)

( * ) Notice: Subject to any disclaimer, the term of this patent is extended or adjusted under 35 U.S.C. 154(b) by 135 days.

(21) Appl. No.: 11/932,785

(22) Filed: Oct. 31, 2007

(65) Prior Publication Data

US 2009/0109122 A1 Apr. 30, 2009

(51) Int. Cl.
*H01Q 15/20* (2006.01)
*H01Q 15/14* (2006.01)

(52) U.S. Cl. ..... 343/915; 343/912

(58) Field of Classification Search ..... 343/878, 343/912, 915

See application file for complete search history.

(56) References Cited

U.S. PATENT DOCUMENTS

| | | | | |
|---|---|---|---|---|
| 4,811,034 | A * | 3/1989 | Kaminskas | 343/915 |
| 4,899,167 | A * | 2/1990 | Westphal | 343/915 |
| 4,905,014 | A * | 2/1990 | Gonzalez et al. | 343/909 |
| 6,198,457 | B1 | 3/2001 | Walker et al. | |
| 6,529,174 | B2 * | 3/2003 | Stjernman et al. | 343/909 |
| 2005/0245498 | A1 | 11/2005 | Shoichet et al. | |

* cited by examiner

*Primary Examiner*—Shih-Chao Chen
(74) *Attorney, Agent, or Firm*—Hoffmann & Baron, LLP

(57) ABSTRACT

A deployable microwave phasing structure having a plurality of planar sub-panels, each of the planar sub-panels having a reflective surface configured to reflect microwaves. In one embodiment, the phasing structure includes a plurality of joints configured to inter-connect the plurality of planar sub-panels to provide a first reflective surface geometry. In one embodiment, the deployable microwave phasing structure includes a plurality of joints configured to inter-connect the plurality of planar sub-panels to provide a first reflective surface geometry. According to another aspect of the invention, the phasing structure includes a phasing arrangement configured to provide an electromagnetic response of a second reflective surface geometry.

24 Claims, 5 Drawing Sheets

DEPLOYABLE PHASING SYSTEM FOR EMULATING REFLECTIVE SURFACES

CROSS REFERENCE TO RELATED APPLICATION

The present application is related to U.S. patent application Ser. No. 11/933,040 entitled System And Method for Providing a Deployable Phasing Structure, filed on even date herewith, assigned to Assignee hereof.

FIELD OF THE INVENTION

The present invention relates in general to phasing structures, and more particularly to a deployable phasing structure for reflecting microwaves within an operating frequency band.

BACKGROUND

In modern antenna and communication systems, reflective surfaces have been designed with specific geometries over specific operating frequency bands. In general, microwave structures include a reflective surface for reflecting microwaves within an operating frequency band. However, conventional antenna systems are not easily transported without significant limitations.

Conventional antenna systems have relied upon separating antenna structures into separate components to facilitate transportation. However, separation of antenna components may lead to loss, damage or separation of antenna components. In addition, packaging and reassembling of antenna components may provide great inconvenience. Further, in situations where time is of the essence (e.g., combat), such limitations in antenna design may cause costly delays, including injury and loss of life.

The use of electromagnetically emulating curved reflective surfaces of any geometry, using a substantially planar microwave reflector antenna configuration, has been suggested. U.S. Pat. No. 4,905,014 issued to Gonzalez et al., Feb. 27, 1990, the contents of which are fully incorporated herein by reference, teaches a phasing structure emulating desired reflective surfaces regardless of the geometry of the physical surfaces to which the electrically thin microwave phasing structure is made to conform. This technology, known as FLAPS (Flat Parabolic Surface), is accomplished by using a dipole antenna placed in front of a ground plane. A low-windload structure has been suggested to provide another version of FLAPS technology. U.S. Pat. No. 6,198,457, issued to Walker et al., Mar. 6, 2001, the contents of which are fully incorporated herein by reference, teaches a low-windload phasing structure including FLAPS technology.

However, known FLAPS phasing structures suffer from the same drawbacks of not being easily deployable in situations where time, space or terrain are otherwise limited or restrictive.

BRIEF SUMMARY OF THE INVENTION

Disclosed and claimed herein is an apparatus for a deployable microwave phasing structure. In one embodiment, the deployable phasing structure includes a plurality of planar sub-panels, each of the planar sub-panels having a reflective surface configured to reflect microwaves. The deployable phasing structure includes a plurality of joints configured to inter-connect the plurality of planar sub-panels to provide a first reflective surface geometry. According to another aspect of the invention, the phasing structure includes a phasing arrangement configured to provide an electromagnetic response of a second reflective surface geometry.

Other aspects, features, and techniques of the invention will be apparent to one skilled in the relevant art in view of the following detailed description of the invention.

DETAILED DESCRIPTION OF EXEMPLARY EMBODIMENTS

Figure 1A:
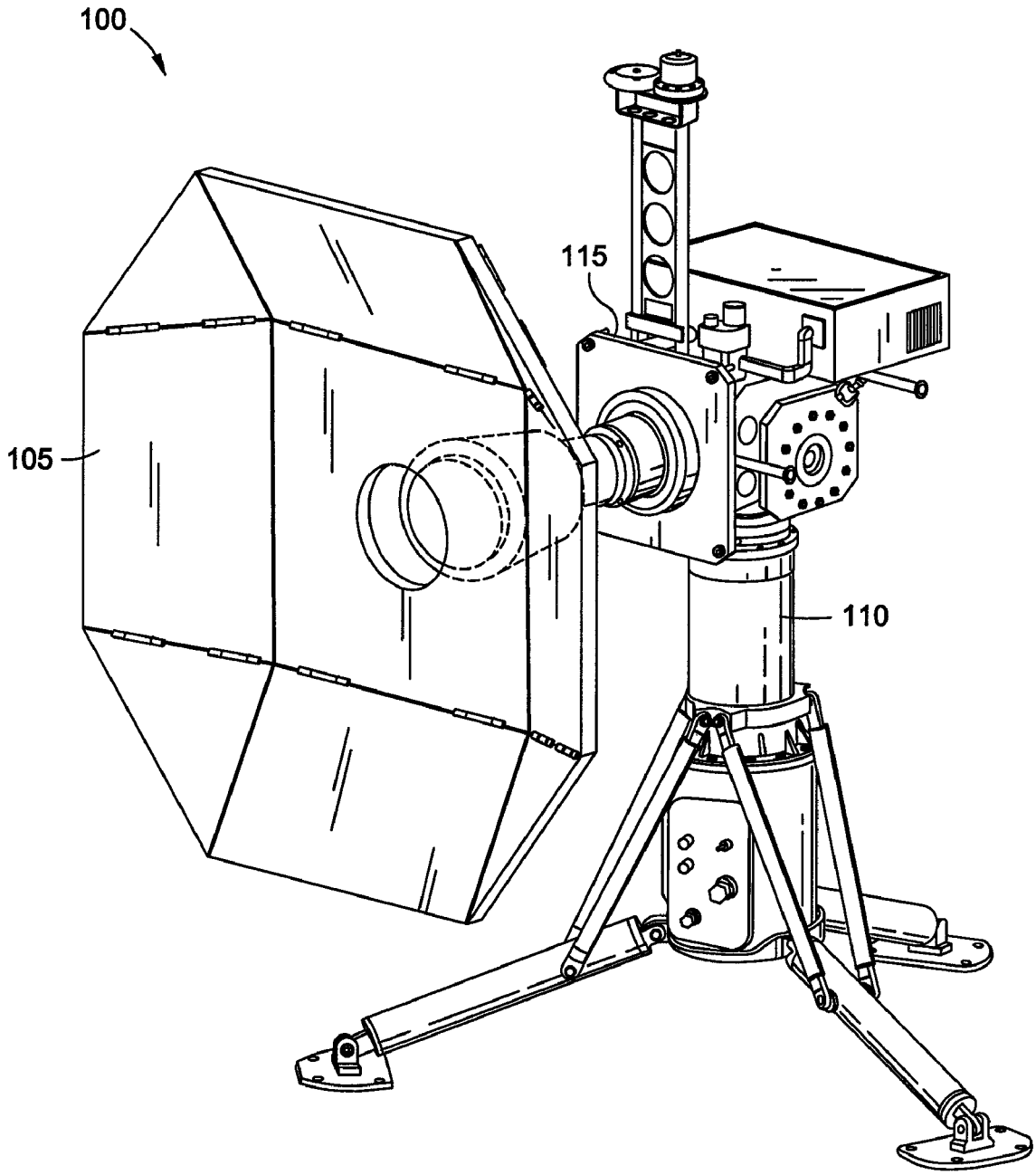
FIGS. 1A-1B depict embodiments of a deployable phasing structure.

One aspect of the invention is to provide a deployable phasing structure having a reflective surface configured to reflect microwaves. According to another embodiment, the phasing structure may emulate a desired reflective surface. Curved (e.g., parabolic) reflective surfaces may be emulated by a reflective surface of the deployable phasing structure using Flat Parabolic Surface (FLAPS) technology. As such, the phasing structure may include a plurality of dipole antennas placed in front of a ground plane. According to one embodiment, the deployable phasing structure may comprise a foldable design. As such, deployment of the phasing structure may be facilitated where space, weight, or physical conditions would otherwise prevent such installation or deployment. The phasing structure or arrangement imparts a phase shift on microwaves.

According to another aspect of the invention, the phasing structure design may provide expansion of a reflective surface from a planar collapsed state to a deployed state. To that end, the deployed state may be configured as one of a planar and non-planar profile. The phasing structure may include a plurality of sub-panels forming a reflective surface when in the deployed position. In one embodiment, sub-panels may have planar profiles. Sub-panels of the phasing structure may be inter-connected by a plurality of joints for example, such that a reflective surface of the phasing structure may be placed in any of a deployed state, an intermediate state and a planar collapsed state. According to another embodiment, a plurality of joints may be provided to inter-connect the sub-panels. The phasing structure may also include a support sub-structure for securing the reflective surface in each of the deployed state and planar collapsed state. Further, transportation of the phasing structure may be facilitated by its foldable design.

It may be appreciated that sub-panels of the reflective surface may be detached from each other to replace a defective sub-panel if necessary. Similarly, a joint configured to interconnect sub-panels of the reflective surface may be separable. In yet another embodiment of the invention, a low windload phasing structure may be provided having a reflective surface providing low resistance to wind.

According to another aspect of the invention, a phasing structure may include an actuator for deployment of the reflective surface. The reflective surface may be configured to deploy from a planar collapsed state to a deployed state from mechanical forces applied by the actuator to the sub-panels, sub-panel joints, or any combination thereof. In another embodiment of the invention, the reflective surface may be expanded using one or more of a mechanical actuator, manual expansion of the panels by a user, a hydraulic element, motorized expansion and expansion through motion of the phasing structure.

As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means any of the following: A; B; C; A and B; A and C; B and C; A, B and C. An exception to this definition will occur only when a combination of elements, functions, steps or acts are in some way inherently mutually exclusive.

Reference throughout this document to "one embodiment", "certain embodiments", "an embodiment" or similar term means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner on one or more embodiments without limitation.

Figure 1B:
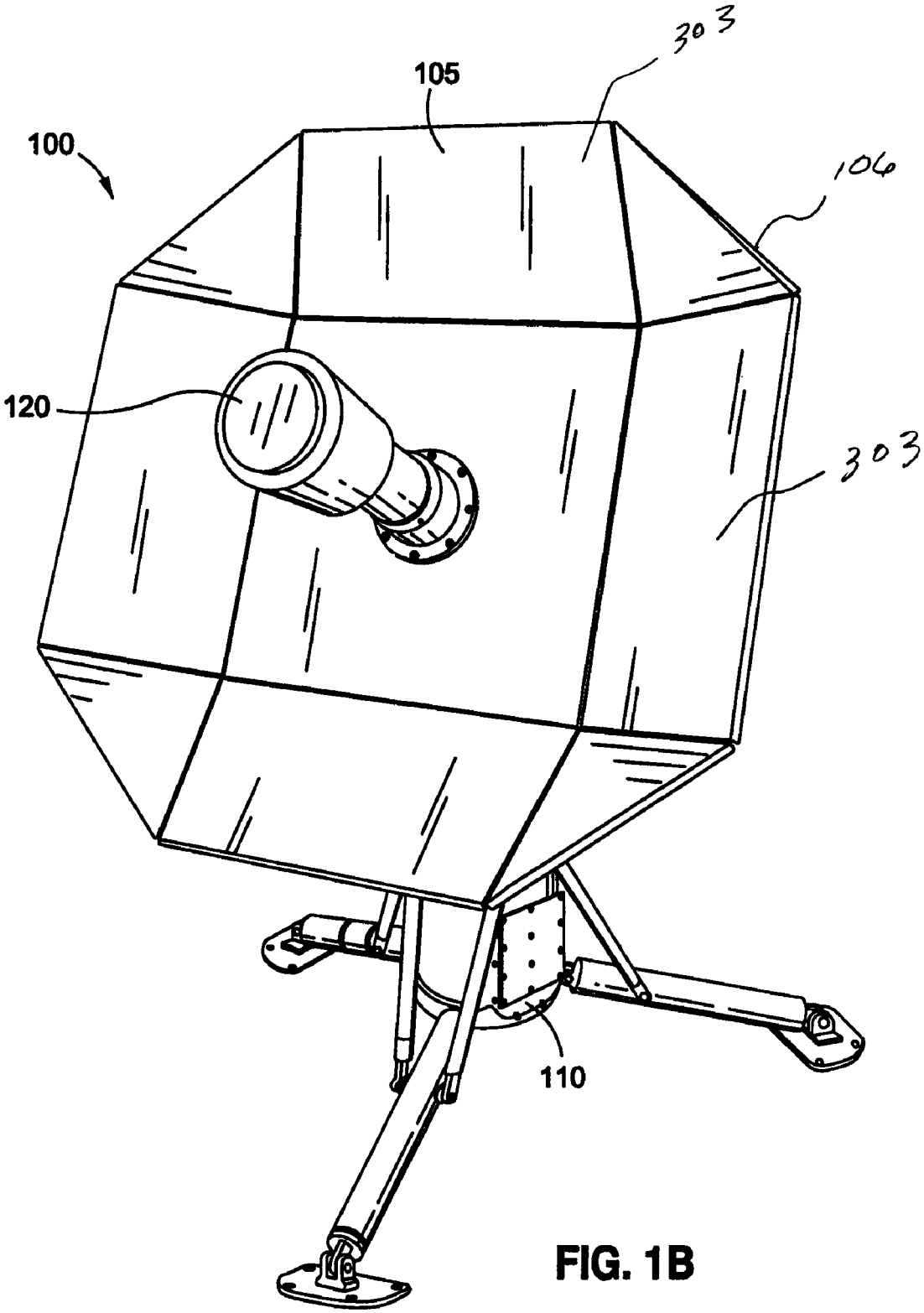

Referring to FIGS. 1A-1B, a deployable microwave phasing structure is depicted according to one or more embodiments of the invention. FIG. 1A depicts a perspective view of antenna assembly 100 including phasing structure 105, pedestal 110 and steering platform 115. As shown, phasing structure 105 is in a non-planar deployed state and detached from steering platform 115. According to one embodiment of the invention, phasing structure 105 may be configured to emulate curved (e.g., parabolic) reflective surfaces. Similarly, antenna assembly 100 may utilize FLAPS technology by including a plurality of dipole antennas and a ground plane 106. An "electrically thin" microwave phasing surface of phasing structure 105 may be fabricated as thin as a fraction of the wavelength of the operating frequency of phasing structure according to one embodiment. The electrically thin phasing surface may provide electromagnetic emulation of a desired reflective surface regardless of the geometry of the physical surfaces to which the electrically thin microwave phasing surface is made to conform.

Referring to FIG. 1B, phasing structure 105 is depicted mounted to pedestal 110. Antenna assembly 100 may be configured to include feed assembly 120, to which electromagnetic energy may be directed to and from. Feed assembly 120 may be one of a horn and horn array. Incident electromagnetic waves transmitted from a source located far away may be focused to a focal point by phasing structure 105, such that feed assembly 120 may detect an incident wave. Phasing structure 105 may be mounted to steering platform (e.g., steering platform 115) capable of aiming the phasing structure 105 at a desired direction. According to another aspect of the invention, feed assembly 120 may be configured to provide electromagnetic energy within an operating frequency band of 1-100 GHZ. It may further be appreciated that antenna assembly 100 may be designed for operation in any frequency band.

Figure 2A:
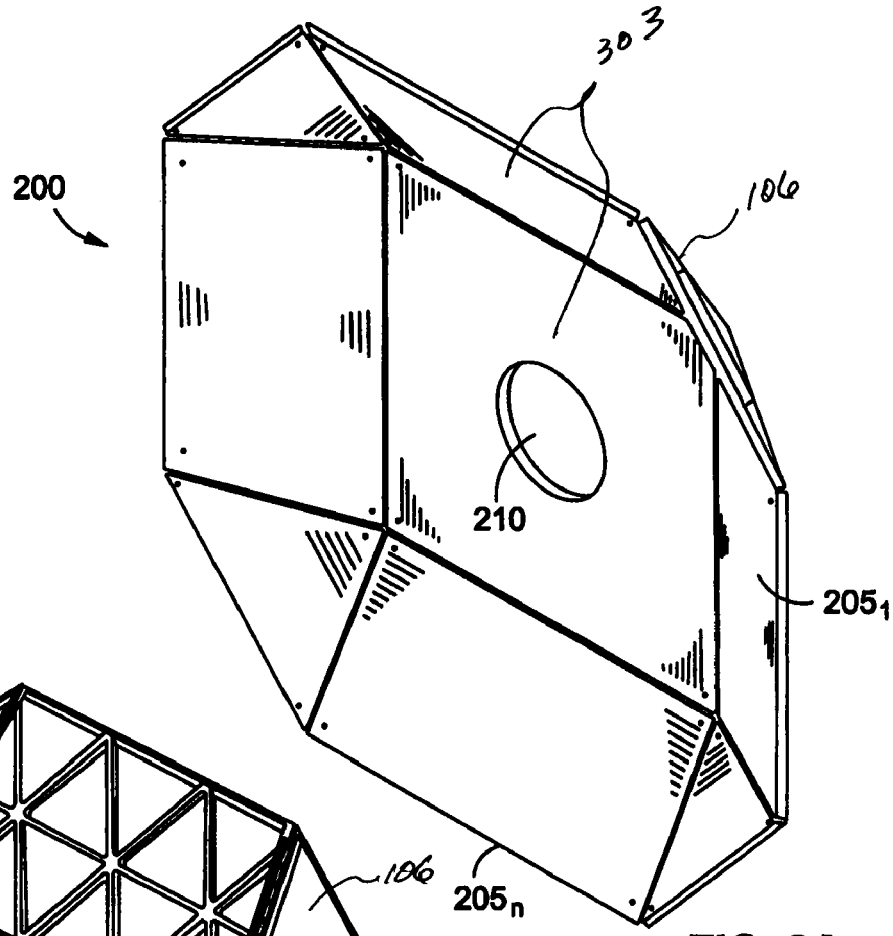
FIGS. 2A-2B depict embodiments of a deployable phasing structure according to the deployable phasing structure of FIGS. 1A-1B.
Figure 2B:
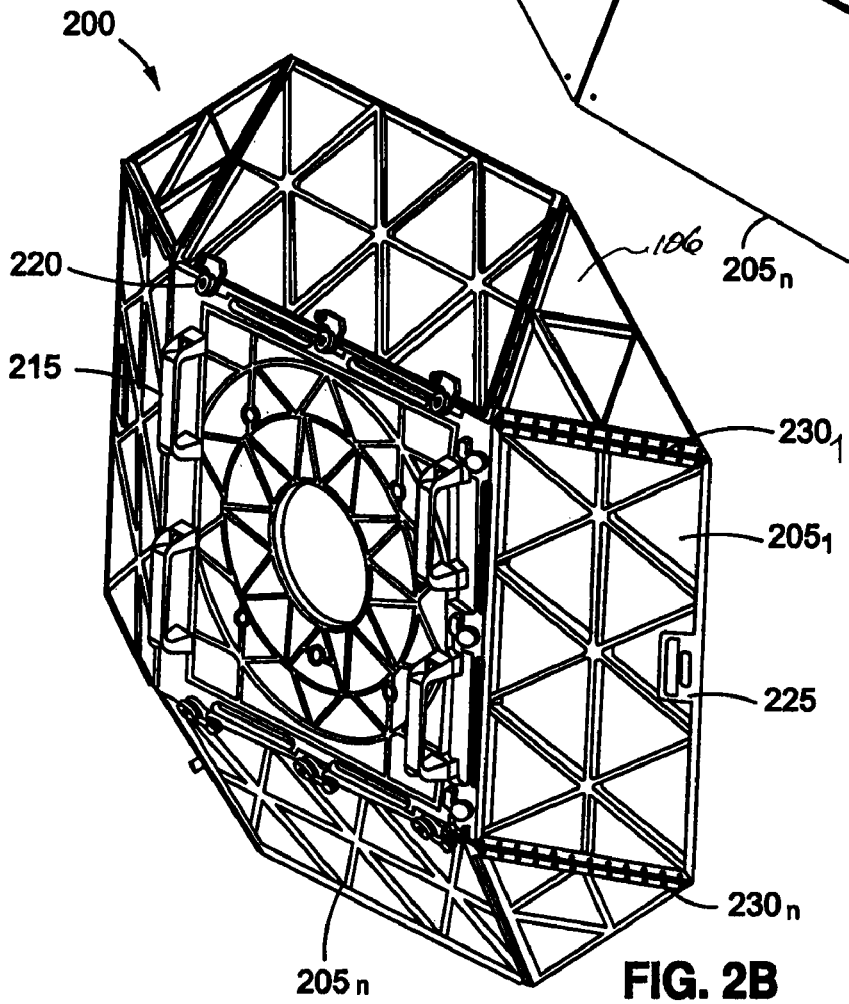

Referring now to FIGS. 2A-2B, a deployable microwave phasing structure is depicted according to one or more embodiments of the invention. FIG. 2A, depicts a side profile view of phasing structure 200 having sub-panels $\mathbf{205}_1$ to $\mathbf{205}_n$. Sub-panels $\mathbf{205}_1$ to $\mathbf{205}_n$ may be configured to provide a reflective surface having a first geometry to reflect microwaves within an operating frequency band. FIG. 2A depicts a non-planar deployed state of $\mathbf{205}_1$ to $\mathbf{205}_n$. In one embodiment of the invention, one of sub-panels $\mathbf{205}_1$ to $\mathbf{205}_n$ may have a recess 210 such that phasing structure 200 may overlay a feed assembly (e.g., feed assembly 120) during assembly of an antenna assembly. To that end, it may be appreciated that sub-panels $\mathbf{205}_1$ to $\mathbf{205}_n$ are without a recess such that a feed assembly may be mounted directly to any of the sub-panels $\mathbf{205}_1$ to $\mathbf{205}_n$ or a point near phasing structure 200. Referring to FIG. 2B, a rear view is depicted of the phasing structure 200 of FIG. 2A. As shown, phasing structure 200 includes a plurality of sub-panels $\mathbf{205}_1$ to $\mathbf{205}_n$. In one embodiment of the invention, phasing structure 200 may include a plurality of joints, such as joints $\mathbf{230}_1$ to $\mathbf{230}_n$, configured to position the phasing structure in a plurality of states. As shown, joints $\mathbf{230}_1$ to $\mathbf{230}_n$ interconnect at least two sub-panels of phasing structure 200. It can be appreciated that joints $\mathbf{230}_1$ to $\mathbf{230}_n$ may additionally provide arrangement of the reflective surface. Joints $\mathbf{230}_1$ to $\mathbf{230}_n$ may be any of a continuous hinge, electric hinge and rotatable mechanical inter-connect. In one embodiment, joints may lock sub-panels $\mathbf{205}_1$ to $\mathbf{205}_n$ in fixed positions once deployed. When locking, joints may be manually or automatically released by components of the phasing structure 200. In one embodiment of the invention, a push button switch may be used to release support components, such that sub-panels of the reflective surface may be arranged. According to another embodiment of the invention, phasing structure 200 may include locking mechanism 220 to secure sub-panels in place when deployed. To that end, locking mechanism 220 may be one of a threaded assembly and mechanical fastener.

Continuing to refer to FIG. 2B, phasing structure 200 further includes handle 215 and latch 225. Latch 225 may be configured to secure phasing structure 200 when collapsed, while the handle 215 may be utilized to inter-connect the phasing structure 200 to a mount (e.g., pedestal mount 115). Handle 215 may further be utilized for one or more of handling, and transporting phasing structure 200. It may also be appreciated that handle 215 may facilitate military use by enabling personnel to easily transport phasing structure 200. In yet another embodiment, handle 215 may be removable from phasing structure 200.

Figure 3A:
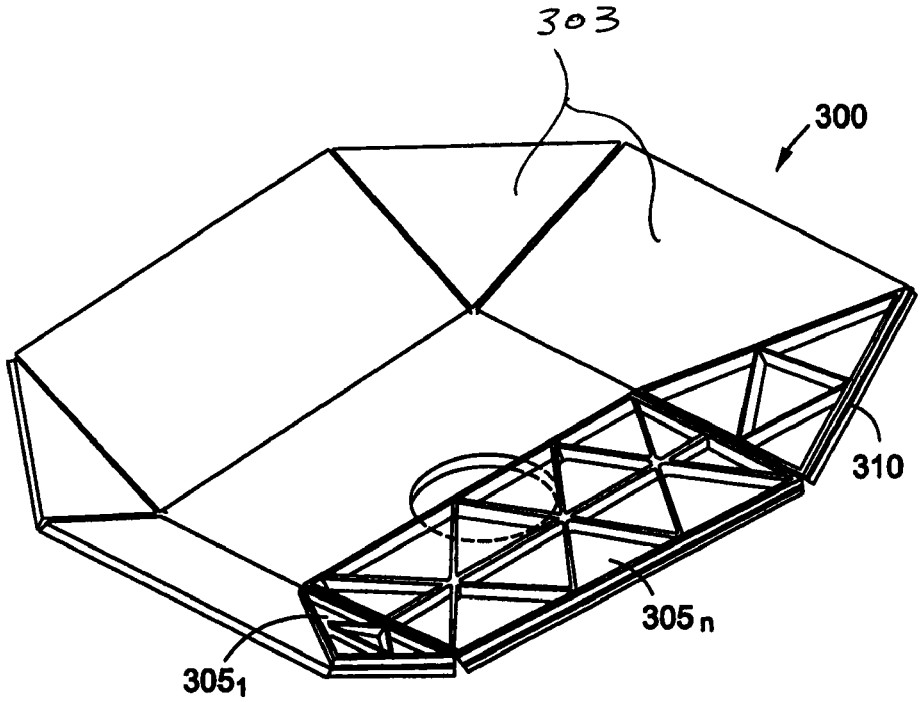
FIGS. 3A-3D depict embodiments of a deployable phasing structure according to the deployable phasing structure of FIGS. 1A-1B.

Referring now to FIGS. 3A-3D, a deployable microwave phasing structure 300 is depicted according to one or more embodiments of the invention. FIG. 3A, depicts a side profile view of phasing structure 300 having inter-connected sub-panels $\mathbf{305}_1$ to $\mathbf{305}_n$ in a non-planar deployed state. Sub-panels $\mathbf{305}_1$ to $\mathbf{305}_n$ may be configured to provide a phasing structure, wherein reflective surfaces of the sub-panels may be configured to reflect microwaves within an operating frequency band. As shown, sub-panels $\mathbf{305}_1$ to $\mathbf{305}_n$ may be arranged in a deployed state having a first geometry and may be configured to emulate a reflective surface having a second geometry. According to another embodiment of the invention, phasing structure 300 may include joints $\mathbf{310}_1$ to $\mathbf{310}_n$ configured to position said reflective surface in a plurality of states. In one embodiment, joints $\mathbf{310}_1$ to $\mathbf{310}_n$ may be locking joints to fix sub-panels $\mathbf{305}_1$ to $\mathbf{305}_n$ in place once the reflective surface is deployed. Locking joints may be manually or automatically released by elements of the phasing structure when the reflective surface is collapsed.

Figure 3B:
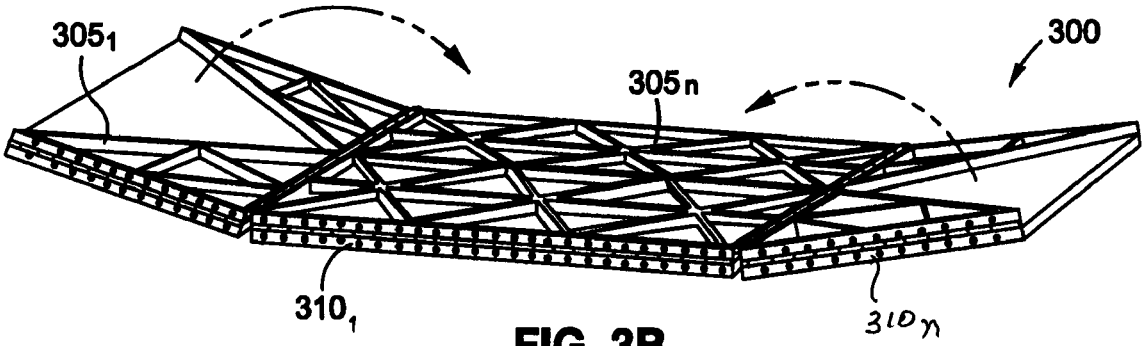
Figure 3C:
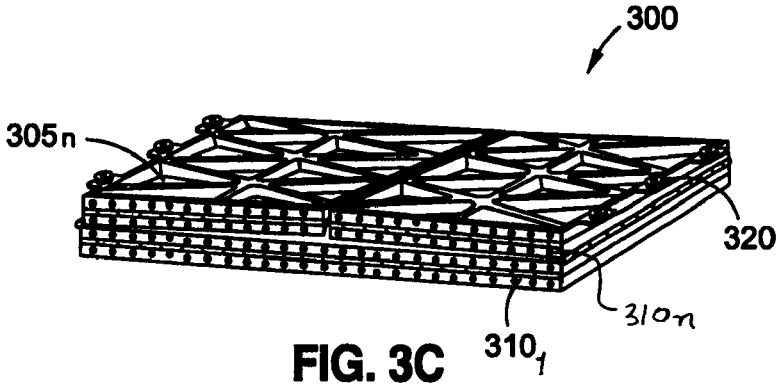
Figure 3D:
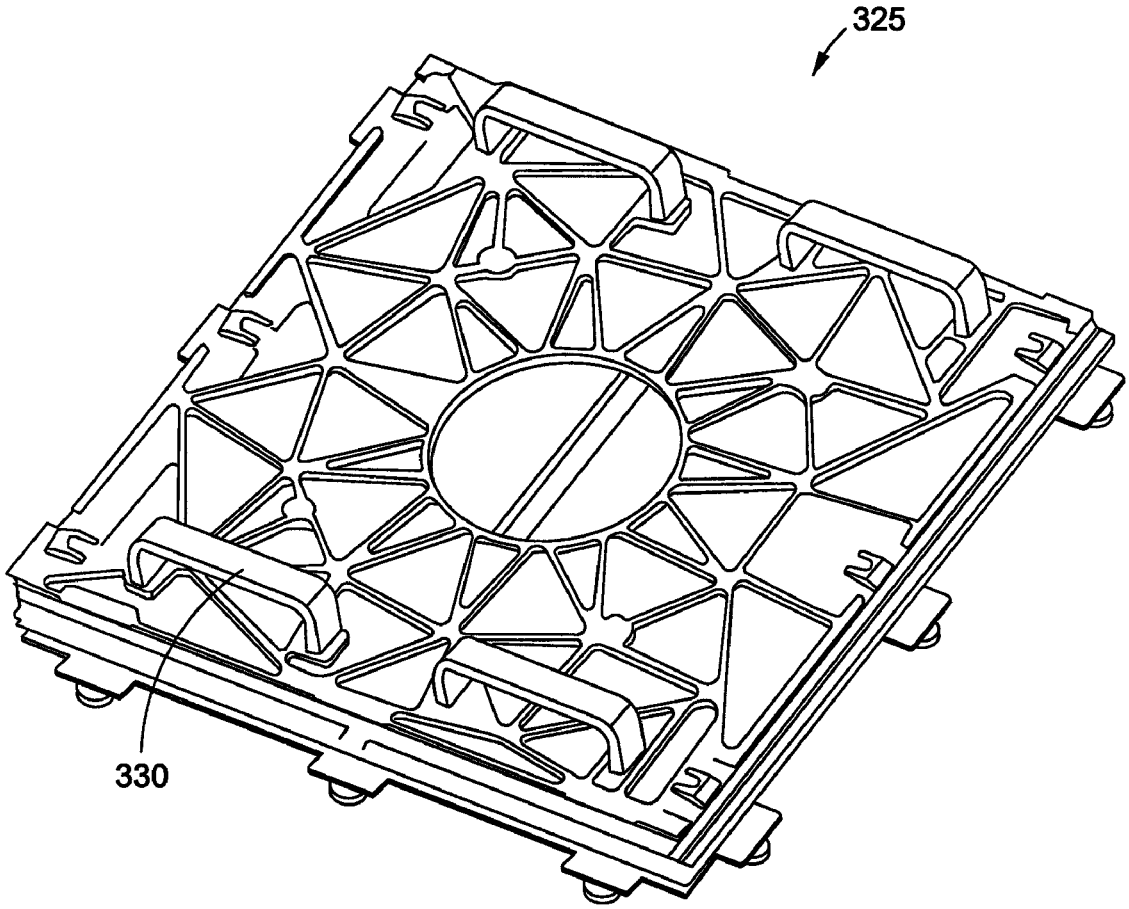

Referring now to FIG. 3B, a side perspective view is depicted of phasing structure 300. As shown, sub-panels $\mathbf{305}_1$ to $\mathbf{305}_n$ of phasing structure 300 are folded in an intermediate state according to one embodiment of the invention. Phasing structure 300 may be collapsed by joint 310 configured to position phasing structure in a plurality of states. By way of example, sub-panels $\mathbf{305}_1$ to $\mathbf{305}_n$ may be collapsed such that opposite sub-panels are brought together to bring reflective surfaces of each sub-panel facing each other with a planar profile as shown in FIG. 3C. While sub-panels $305_1$ to $305_n$ are depicted as having a non-planar deployed, intermediate and planar collapsed states, it may further be appreciated that phasing structure 300 may conform to additional configuration states. Phasing structure 300 may be transported in the planar collapsed state according to one aspect of the invention. Transportation and storage of phasing structure 300 may be facilitated due to its planar collapsed design. As such, a planar collapsed design of phasing structure 300 is desirable for military applications. According to another embodiment of the invention, phasing structure 300 may include locking mechanism 320 to secure sub-panels in place when deployed. Referring now to FIG. 3D, a rear view of phasing structure 325 is depicted having a planar profile according to one embodiment of the invention. Phasing structure 325 may include handle 330 to facilitate handling.

According to one embodiment of the invention, phasing structure 300 may be provided including a reflective surface, wherein the reflective surface includes a plurality of replaceable sub-panels (i.e., sub-panels $305_1$ to $305_n$). It may be appreciated that sub-panels $305_1$ to $305_n$ of phasing structure 300 may be detached to replace a defective sub-panel if necessary. According to another aspect of the invention, a joint (i.e., joint 310) configured to inter-connect sub-panels of the reflective surface may be separable.

According to another aspect of the invention, phasing structure 300 may be deployed through one or more arranging means 307 shown in FIG. 3C including a mechanical actuator, manual expansion of the panels by a user, a hydraulic element, motorized expansion and expansion through motion of the phasing structure. When deployed through motion, phasing structure 300 may be manipulated such that components (i.e., sub-panels 3051 to $305_n$) of phasing structure 300 are unfolded as the phasing structure 300 is manipulated. In one embodiment, gravitational forces acting on the reflective surface may aid in deployment. In a further embodiment of the invention, the reflective surface of the phasing structure 300 may be deployed through expansion of the reflective surface by a user. In one embodiment of the invention, material of the reflective surface may be configured to fold onto itself. One principal advantage of the phasing structure 300 according to one embodiment of the invention, may be that deployment may be achieved with minimal time delay.

According to another aspect of the of the invention, the dimensions, orientation and interspacing of electromagnetically-loading structures 303 within phasing structure 300 may be determined by one of computer-aided design system, a three-dimensional ray tracing (i.e., path length) model of the microwave phasing surface and the desired reflective surface of selected geometry as disclosed in more detail in previously incorporated U.S. Pat. No. 4,905,014. Metallic layers may be provided on the other side of the dielectric substrate. A composite pattern corresponding to the determined arrangement of electromagnetically-loading structures may be generated. Portions of the metallic layer may be removed, using in the preferred embodiment a photo-etching process, thereby leaving remaining therein the generated composite pattern corresponding to the arrangement of electromagnetically-loading structures.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art. Trademarks and copyrights referred to herein are the property of their respective owners.

What is claimed is:

1. A deployable microwave phasing structure comprising:

a plurality of planar sub-panels, said planar sub-panels each having a reflective surface configured to reflect microwaves;

a plurality of joints configured to inter-connect the plurality of planar sub-panels to provide a first reflective surface geometry, the plurality of joints enabling at least two of the plurality of planar sub-panels to fold together along an axis that is non-normal to any portion of the first reflective surface geometry; and a phasing arrangement configured to provide an electromagnetic response of a second reflective surface geometry.

2. The deployable microwave phasing structure of claim 1, wherein said phasing arrangement is configured to reflect microwaves within an operating frequency band.

3. The deployable microwave phasing structure of claim 1, wherein said phasing arrangement comprises a plurality of electromagnetically-loading structures supported by said plurality of planar sub-panels.

4. The deployable microwave phasing structure of claim 3, wherein said phasing arrangement further comprises a ground plane.

5. The deployable microwave phasing structure of claim 1, wherein said plurality of joints are further configured to arrange said plurality of planar sub-panels into a plurality of states.

6. The deployable microwave phasing structure of claim 5, wherein said plurality of states comprises at least one of a deployed state, intermediate state and collapsed state.

7. The deployable microwave phasing structure of claim 1, wherein said plurality of planar sub-panels are low windload panels, having low wind resistance.

8. The deployable microwave phasing structure of claim 1, wherein said reflective surface is substantially planar and said first reflective surface geometry is substantially non-planar.

9. A deployable microwave phasing structure comprising:

a plurality of planar sub-panels, said planar sub-panels each having a reflective surface configured to reflect microwaves;

a folding means for inter-connecting the plurality of planar sub-panels to provide a non-planar first reflective surface geometry, the folding means enabling at least two of the plurality of planar sub-panels to fold together along an axis that is non-normal to any portion of the first reflective surface geometry; and a phasing means for providing an electromagnetic response of a second reflective surface geometry.

10. The deployable microwave phasing structure of claim 9, wherein said phasing means is configured to reflect microwaves within an operating frequency band.

11. The deployable microwave phasing structure of claim 9, wherein said phasing means comprises a plurality of electromagnetically-loading structures supported by said plurality of planar sub-panels.

12. The deployable microwave phasing structure of claim 11, wherein said phasing means further comprises a ground plane.

13. The deployable microwave phasing structure of claim 9, wherein said folding means further arranges said plurality of planar sub-panels into a plurality of states.

14. The deployable microwave phasing structure of claim 13, wherein said plurality of states comprises at least one of a deployed state, intermediate state and collapsed state.

15. The deployable microwave phasing structure of claim 9, wherein said plurality of planar sub-panels are low wind-load panels, having low wind resistance.

16. The deployable microwave phasing structure of claim 9, wherein said reflective surface is substantially planar and said first reflective surface geometry is substantially non-planar.

17. A foldable microwave phasing structure comprising:

a plurality of planar sub-panels configured to reflect microwaves, said planar sub-panels each panel having a reflective surface;

a phasing arrangement configured to impart a phase shift on said microwaves to provide an electromagnetic response of a second reflective surface geometry; and at least one joint configured to:

inter-connect said plurality of planar sub-panels; and arrange said plurality of planar sub-panels into a plurality of states to provide a non-planar first reflective surface geometry, the at least one joint enabling at least two of the plurality of planar sub-panels to fold together along an axis that is non-normal to any portion of the first reflective surface geometry.

18. The deployable microwave phasing structure of claim 17, wherein said phasing arrangement is configured to reflect microwaves within an operating frequency band.

19. The deployable microwave phasing structure of claim 17, wherein said phasing arrangement comprises a plurality of electromagnetically-loading structures supported by said plurality of planar sub-panels.

20. The deployable microwave phasing structure of claim 19, wherein said phasing arrangement further comprises a ground plane.

21. The deployable microwave phasing structure of claim 17, wherein said at least one joint is further configured to arrange said plurality of planar sub-panels into a plurality of states.

22. The deployable microwave phasing structure of claim 21, wherein said plurality of states comprises at least one of a deployed state, intermediate state and collapsed state.

23. The deployable microwave phasing structure of claim 17, wherein said plurality of planar sub-panels are low wind-load panels, having low wind resistance.

24. The deployable microwave phasing structure of claim 17, wherein said reflective surface is substantially planar and said first reflective surface geometry is substantially non-planar.

* * * * *